United States Patent [19]

MacKenzie

[11] Patent Number: 4,463,854

[45] Date of Patent: Aug. 7, 1984

[54] BOOK SUPPORT ASSEMBLY

[76] Inventor: David D. MacKenzie, 350 Carpenter Dr., Apt. 820, Atlanta, Ga. 30328

[21] Appl. No.: 458,204

[22] Filed: Jan. 17, 1983

[51] Int. Cl.[3] ..... A47B 65/00

[52] U.S. Cl. ..... 211/43; 248/558; 211/2; 211/184

[58] Field of Search ..... 211/43, 184, 2; 108/61; 248/558; 269/130, 132; 24/115 G, 115 M, 129 C; 242/149

[56] References Cited

U.S. PATENT DOCUMENTS

| | | | |
|---|---|---|---|
| 563,409 | 7/1896 | Pickford | 269/130 X |
| 1,286,374 | 12/1918 | McDonald | 211/51 X |
| 2,334,251 | 11/1943 | Clift | 211/43 |
| 2,807,369 | 9/1957 | Stark | 211/2 |
| 2,912,151 | 11/1959 | Crabs | 211/51 X |
| 3,195,480 | 7/1965 | Meyer | 211/2 X |
| 3,399,782 | 9/1968 | Bascom | 108/61 X |
| 4,135,626 | 1/1979 | Cawood | 211/43 |

*Primary Examiner*—Ramon S. Britts
*Assistant Examiner*—Sarah Ann Lechok
*Attorney, Agent, or Firm*—Louis T. Isaf

[57] ABSTRACT

A book support assembly comprises a system of adjustable bookends including two end members connected together by a relaxed cord which cord is adjustable in length by use of a manually operated mechanical windlass device. The book support assembly is convertable from bookends to a lectern.

7 Claims, 6 Drawing Figures

BOOK SUPPORT ASSEMBLY

FIELD OF THE INVENTION

The present invention relates generally to the Field of Book Supports such as bookends and lecterns and more specifically to bookends which are connected together in adjustable, spaced apart relationship and which are convertible into a lectern.

BACKGROUND OF THE INVENTION

Bookends of numerous designs have existed for years comprising generally two end members which abut against opposite sides of a book or stack of books to hold the books in an upright position. Designers have utilized various methods to prevent the bookend members from sliding under the weight of books. Originally, the end members were weighted, or each end member included a lower flange which extended underneath the books so that the weight of the books held the end member in place. Later designs made use of methods for attaching the two end members together in a manner which would prevent the end members from spreading apart under the weight of the books but also make the distances between the two end members adjustable. The vast majority of these interconnected bookend systems made use of an elastic or spring like member connected between the two end members. The elastic or spring member is held in tension when books are placed between the two end members and the resilient action of the elastic member automatically retracts upon removal of a book to draw the bookends together and secure the remaining books. Examples of such devices are seen in patents to Hoffman U.S. Pat. No. 1,395,825, Riddel U.S. Pat. No. 1,876,346, Schreyer U.S. Pat. No. 2,284,849, Sooter U.S. Pat. No. 2,665,010 and Howkinson U.S. Pat. No. 3,679,064. Another design has utilized a tie-cord between a pair of supports, with an arrangement for wrapping the cord about lugs at each end to retain the support in a desired spaced relationship, see for example Clift U.S. Pat. No. 2,334,251. However, all of the previous designs, to some persons, are clumsy and difficult to handle, or fail to provide the user with selectable adjustments in spacing and other manners of use.

SUMMARY OF THE INVENTION

Briefly described, the present invention comprises an adjustable bookend assembly which comprises two end members which are connected together by a relaxed cord member. The relaxed cord member prevents the two end members from being spread further apart than the user desires but does not automatically retract the end members to draw them into contact with books in between. Rather, the relaxed cord member is adjustable in length by use of a manually operated mechanical winch or other windlass device. Therefore, a distance between the two end members can be adjusted at the election of the user and the distance between the two end members is set independently of the number of books or other articles therebetween. Once the user elects to change the distance between the end members, such user must manually operate the mechanical windlass to effect the spacing change.

In a particular embodiment of the present invention, the components of the bookend assembly are positioned, alternately, to function as a lectern to support a book for reading.

It is, therefore, an object of the present invention to provide a pair of bookends which are interconnected, with the distance between the end members being adjusted by mechanical means at the election of the user.

Another object of the present invention is to provide a bookend assembly which is infinitely adjustable at the election of a user by manual operation of a mechanical windlass device.

Yet another object of the present invention is to provide a book support assembly which functions alternately as either a bookend type book support or a lectern type book support.

Still another object of the present invention is to provide a support assembly for securely holding books, magazines, records, cards, cassettes and other stackable objects.

Other objects, features and advantages of the present invention will become apparent upon reading the following specification, when taken in conjunction with the accompanying drawings.

DETAILED DESCRIPTION OF THE PREFERRED EMBODIMENT

Figure 1:
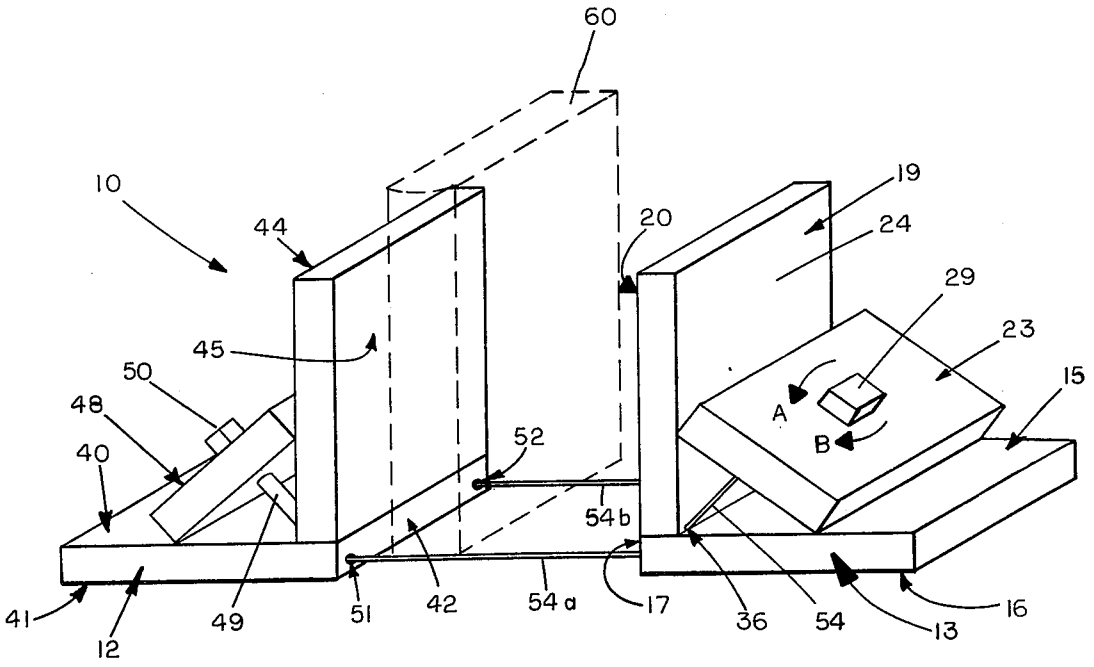
FIG. 1 is a pictorial view of the book support assembly in accordance with the present invention, used in the bookend mode.

Referring now in greater detail to the drawings in which like numbers represent like components throughout the several views, FIG. 1 shows the book support assembly 10 being used as bookends. The book support assembly 10 includes a left bookend member 12 and a right bookend member 13. The right end member 13 includes a base plate 15 which has a flat, bottom surface 16 and a flat, book facing edge 17. A book support plate 19 is attached to and rises perpendicularly from the base plate 15 and is aligned along the book facing edge 17 of the base plate 15. The support plate 19 includes a flat, book abutting surface 20. A first passage 36 and second passage 37 are formed in the right end member 13 as seen in the drawings. A third plate 23 (also referred to as the bar support plate 23) is seen leaning against the backside 24 of the support plate 19 of the right end member 13 and is attached by screws, glue or other means to the top side of the base plate 15 and the backside of the support plate 19 in the slanted fashion as shown. In the preferred embodiment, the third plate 23 makes an angle of approximately 45 degrees with the base plate 15; however, the angle may vary through a wide range. As seen in greater detail in FIGS. 2 and 3, the right end member 13 further includes a cylindrical shaped bar member 26 which extends through a channel 27 formed in the bar support plate 23. The bar member 26 extends generally perpendicular to the bar support plate 23. At one of its ends, the bar member 26 is rigidly attached to a square head portion 29. The free end 30 of the bar member 26 is inserted into a bore hole 32, which bore hole is drilled into the base plate 15 and partially through the book support plate 19 at the juncture of the base plate and book support plate. A hole 34 is bored through the bar member 26 as shown in FIGS. 2 and 3.

The left bookend member 12 includes a base plate 40 which has a flat bottom surface 41 and a flat, book facing edge 42. A book support plate 44 is attached to and extends perpendicularly above the base plate 40. The book support plate 44 is aligned along the book facing edge 42 of the base plate 40. The book support plate 44 includes a flat, book abutting surface 45. A first passage 51 and second passage 52 are formed in the left end member 12 as seen in the drawings. Strictly as a matter of design choice, a slanted bar support plate 48 has been mounted on the left bookend member 12 and a bar member 49 with square head portion 50 have been attached to the left bookend member 12. The slanted plate 48, bar member 49 and square head 50 of the left end member 12 are shown in FIG. 1, and other figures, as being designed to match those similar components mounted on the right bookend member 13. The sole purpose for the slanted plate 48, bar member 49 and square head on the left bookend member 12 is to give design symmetry to the book support assembly 10. The slanted plate 48, bar member 49 and square head 50, can be completely eliminated as in FIGS. 2 and 3 without affecting the present invention. In alternate embodiments the base plate 40 of the left bookend member 12 is shortened as in FIGS. 2 and 3. Such an alternate embodiment is useful in permitting the left end member to be moved closely against a bookshelf wall.

Figure 2:
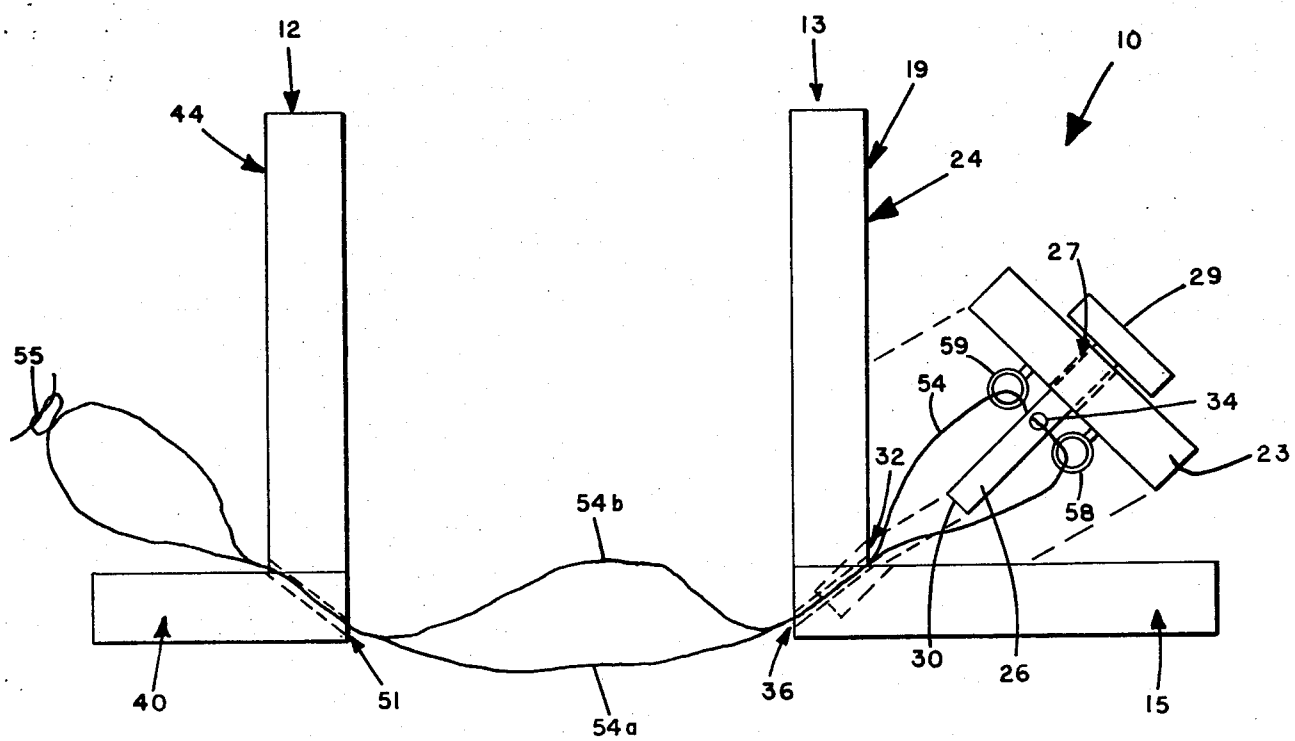
FIG. 2 is a side view of the book support assembly of FIG. 1, in the bookend mode, with a portion exploded away for clarity, and with the cord in a completely unwound state and showing an alternate design for the left bookend member.
Figure 3:
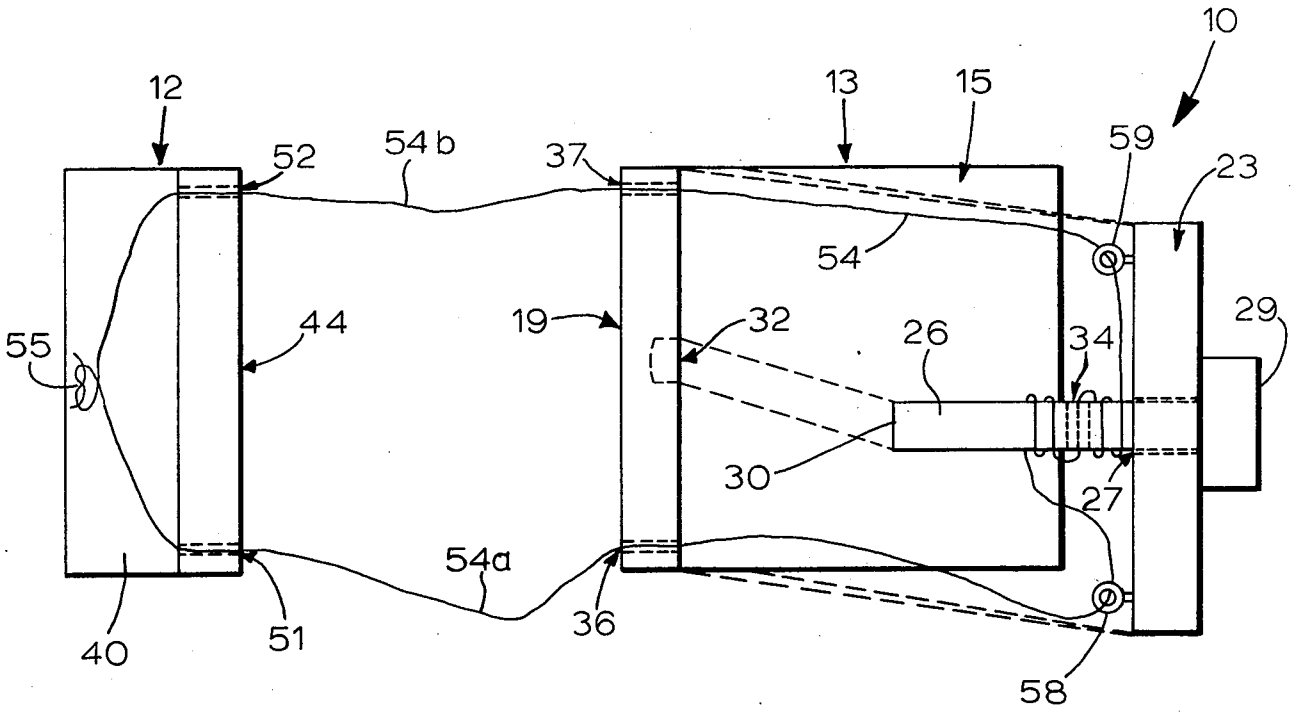
FIG. 3 is a top view of the book support assembly of FIG. 2, in the bookend mode, with a portion exploded away for clarity and with the cord partially wound.

In the preferred embodiments of the present invention, as seen in FIGS. 1–3, two lengths of cord 54A, 54B extend between the left end member 12 and the right end member 13. Preferrably, as shown in detail in FIGS. 2 and 3, the two lengths of cord 54A and 54B are simply portions of a single, continuous length of cord 54. The cord 54, of the preferred embodiment, is of a string like material which is in a typically relaxed state. The term "relaxed" as used throughout this application is intended to define a condition in which the cord, when left alone, does not recoil or spring-back to a different shape or length. Preferrably, the cord 54 is of a string material which is not elastic, in that it does not stretch when pulled on. However, it is within the scope of this invention to use elastic cord, as long as that elastic cord, in its relaxed state, is sufficiently long to allow the bookend members 12, 13 to be moved apart when the cord 54 is unwound and such that the two end members will remain in the spaced apart relationship.

As seen most clearly in FIG. 3, the cord 54 is strung throughout the support assembly 10 by first passing an end of the cord through the first passage 51 of the left end member 12 so that the cord comes out of the book facing edge 42 near the bottom surface 41 of the base plate 40. The cord end is then passed through the first passage 36 of the right end member 13 from the book facing edge 17 to the backside 24 of the support plate 19. The cord end is then passed through an eyelet 58 which is attached beneath the bar support plate 23. From the eyelet 58, the cord end is passed through the hole 34 formed in bar member 26, through a second eyelet 59 supported from the bar support plate 23, through the second passage 37 of the right end member 13 (passing from the back to the front side), and finally the cord end is passed through second passage 52 of the left bookend member 12 (from the front to the backside). The two end members of the cord 54 are tied together behind the book support plate 44 of the left end member 12 to form a knot 55.

Operation. The book support assembly 10 of the present invention is completely assembled when the cord 54 has been strung and tied as mentioned above and the bar support plate 23 and bar member 26 have been mounted to the right bookend member 13 as described above with the bar member, free end 30 placed in bore hole 32 and the bar support plate 23 glued, screwed or otherwise attached to the base plate 15 and book support plate 19. The bar member 26 is rotatable within the channel 27 and bore hole 32 by action of a user manually turning of the square head 29 which acts as a crank 29. Turning of the crank 29 (i.e. in direction of arrow A in FIG. 1) which rotates the bar member 26 about its cylindrical axis results in the cord 54 being wound about the bar member 26. The hole 34 formed in the bar member 26 and through which the cord 54 passes functions to grip the cord as the bar member rotates and thus assures winding of the cord. Since the cord 54 extends continuously through the hole 34 and between eyelets 58, 59 positioned on opposite sides of the bar member 26 (as seen in FIGS. 2 and 3), the cord winds about the bar member 26 from two different directions, and the two cord portions 54A, 54B, of the single cord 54, are simultaneously wound about the bar member. By turning the crank in the opposite direction (i.e. the direction of arrow B in FIG. 1), the cord is unwound from about the bar member 26. Preferably, the bar member 26 fits at least snugly within the channel 27 and bore hole 32 in order that a limited friction force is created which prevents the bar member from rotating without the action of the user.

With the cord completely unwound as seen in FIG. 2, the bookend members 12, 13 can be moved to their furthest distance away from one another. That furthest distance, for example 10 or 12 inches, is limited by the length of cord 54. The end members 12 and 13 are not forced apart by action of the cord, since the cord is not a rigid structure. Rather, the user moves the two end members apart. As the crank 29 is turned (in the direction of arrow A for purposes of this description) the cord is wound about the bar member 26 which effectively shortens the length of cord 54. This winding, likewise, shortens the distance to which the end members 12 and 13 can be moved apart by the user. If the two end members 12, 13 are at their furthest allowed distance from one another, winding of the cord will draw the left end member 12 closer to the right end member 13. To again move the bookends further apart, the crank is turned in the direction of arrow B to unwind the cord 54 and lengthen the effective length of the cord 54 after which the user may move the end members 12, 13 further apart. Therefore, to hold, for example, one book between the bookends, the user places a book 60 between the two end members 12, 13 and turns the crank 29 winding up the cord 54 and drawing the left end member 12 closer to the right end member 13 until the book abutting surfaces 20, 45 of the two end members are held snugly against the book. To add a book to the row, crank 29 is turned in the direction of arrow B to unwind cord 54 enough that the left end member 12 can be moved far enough from the right end member 13 to fit another book there between. Then the crank 29 is again turned in the direction of arrow A to draw the left end member 12 and right end member 13 snugly against the books. As an added feature, the books 60 rest on top of the two lengths of cord 54A, 54B and, as such, the entire support assembly 10, loaded with books 60, can be picked up and moved for dusting or relocation.

Figure 4:
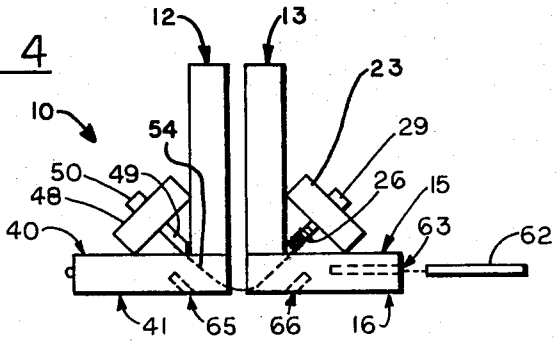
FIG. 4 is a side view of the bookend assembly of FIG. 1, with the cord in a fully wound state.
Figure 5:
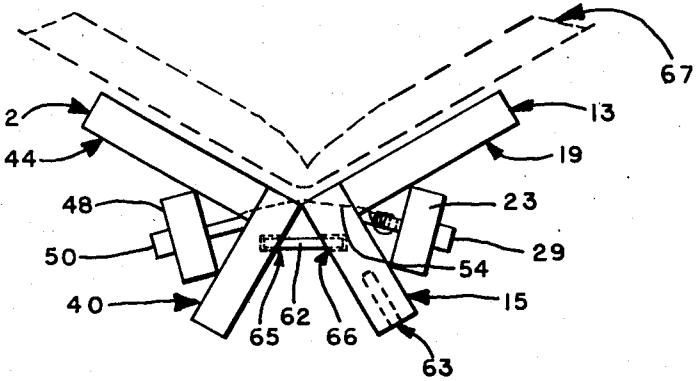
FIG. 5 is a side view of the bookend assembly in accordance with the present invention, used in the book lectern mode.

In the preferred embodiment, as seen in FIGS. 4 and 5, the book support assembly 10 is provide with a dowel 62. The dowel 62 is not normally attached in any functional manner to the left or right end members 12, 13, but it is stored until needed, to prevent its loss, in a dowel storing cavity 63 formed in the right end member 13. A dowel accepting recess 65 is formed in the base plate 40 of the left end member 12. The left dowel accepting recess 65 opens onto the bottom surface 41 of the base plate 40 and, preferrably, defines a cylindrical cavity angling from the back to the front of the base plate (left to right as seen in FIG. 4). A dowel accepting recess 66 is also formed in the base plate 15 of the right end member 13. The right dowel accepting recess 66 opens onto the bottom surface 16 of the base plate 15 and, preferrably, defines a cylindrical cavity angling from the back to the front side of right end member 13 (right to left as seen in FIG. 4). Through the cooperative interaction of the dowel 62 and the two dowel accepting recesses 65, 66, the book support assembly 10 of the present invention is convertible from a conventional bookend support system (as in FIGS. 1 and 4) to a lectern type book support as seen in FIG. 5. This conversion is accomplished by inserting the dowel 62 in place with one of its ends inserted in the dowel accepting recess 65 of the left end member 12 and the other end of the dowel inserted in the dowel accepting recess 66 of the right end member 13. The base plates 15, 40 of the two end members 12, 13 thus placed with their book facing edges (butt edges) 17, 42 in near abutment and the book support plates 19, 44 defining an angled book supporting surface on which an open book 67 can be rested. Once the end members 12, 13 are in position as described and as seen in FIG. 5, the cord 54 is wound by turning the crank 29 as described above drawing the two end member 12, 13 tightly against the dowel 62 and preventing the dowel from slipping out and preventing the end members 12, 13 from twisting about the dowel. It is understood that, if the dowel fits snugly enough within the two dowel accepting recesses 65,66, the cord 54 need not be wound to hold the end members 12, 13 in place, although such is still preferred.

Figure 6:
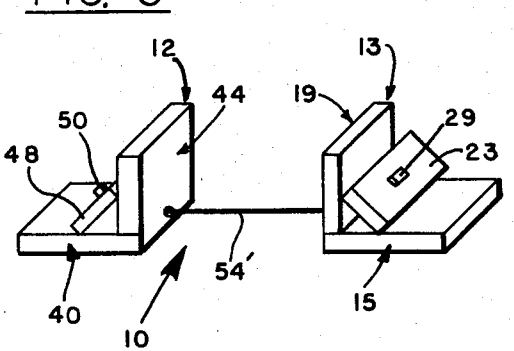
FIG. 6 is a pictorial view of the bookend assembly of FIG. 1, but showing an alternate embodiment thereof.

In alternate embodiments of the present invention, the two cord lengths 54A, 54B comprise separate pieces of cord which are not tied together in a continuous loop as in the preferred embodiment. Rather, each piece of rope is tied at one of its ends to the left bookend member 12 and is connected at its other end to cord gripping device (i.e. hole 34) of the bar member 26 of the windlass assembly. In still another embodiment of the present invention, as seen in FIG. 6, the cord 54' extending between the two end members 12, 13 comprises a single length of cord which is tied off at one of its ends to the left end member 12 and tied at its other end in some manner to the hole 34 or other cord gripping device of the bar member 26.

Whereas this invention has been described in detail with particular reference to preferred embodiments thereof, it will be understood that variations and modifications can be effected within the sphere and scope of the invention as described hereinbefore and as defined in the appended claims.

I claim:

1. Apparatus for supporting books or like articles; comprising:

first end member including an abutment surface for supportably abutting such article, base surface extending perpendicular to said abutment surface and a butt edge defined at the intersecting edges of said abutment surface and said base surface;

second end member including an abutment surface normally disposed in opposed relation to said abutment surface of said first member for supportably abutting articles therebetween, said second end member being movable relative to said first end member for adjusting the spacing between said abutment surfaces; and wherein said second end member includes a base surface extending perpendicular to said abutment surface of said second end member and a butt edge defined at the intersecting edges of said abutment surface and said base surface;

at least a first cord member in a normally relaxed state extending between said first end member and said second end member, said cord member intertying said first end member and said second end member to limit the distance to which said second end member is movable away from said first end member;

manually operated spindle means associated with said first end member for electively and alternately winding said cord member about a bar member of said spindle means and unwinding said cord member, a dowel accepting recess defined in said base surface of said first end member, said recess piercing said base surface at an acute angle;

a dowel accepting recess defined in said base surface of said second end member, said recess piercing said base surface at an acute angle; and a dowel comprising a first end removably inserted into said dowel accepting recess of said first end member and a second end removably inserted into said dowel accepting recess of said second end member, whereby said butt edges of said first and second end members are in near abutment and said abutment surfaces of said first and second end members define an obtuse angle therebetween when said dowel is in place with both said ends of said dowel inserted in the respective dowel accepting recesses thus defining a lectern type book support, and whereby winding of said cord member to a point of tension in said cord member maintains said dowel in place.

2. Apparatus for supporting books or like articles, comprising:

first end member including an article abutting surface for supportably abutting such article;

second end member including an article abutting surface normally disposed in opposed relation to said surface of said first end member for supportably abutting articles therebetween;

said second end member being movable relative to said first end member for adjusting the spacing between said surfaces;

manually operated spindle assembly mounted to said first end member, said spindle assembly including an elongated bar member rotatable about its longitudinal axis, cord gripping means associated with said bar member for gripping a cord to be wound about said bar member, a crankhead connected to said bar member, and support means for supporting said bar member in rotatable fashion; and a cord system intertying said first end member and said second end member to limit the distance to which said second end member is movable away from said first end member, said cord system including a first, normally relaxed cord element extending from said second end member to said first end member and to said cord gripping means of said spindle assembly and a second, normally relaxed cord element extending from said second end member to said first end member and to said cord gripping means, whereby turning of said crankhead in a first direction rotates said bar member about its elongated axis and simultaneously winds said first and second cord elements about said bar member to decrease the distance to which said second end member is movable away from said first end member, and turning of said crankhead in a second direction rotates said bar member and unwinds said first and second cord elements from said bar member to increase the distance to which said second end member is movable away from said first end member.

3. Apparatus of claim 2, wherein said first normally relaxed cord element and said second normally relaxed cord element interconnect to define a continuous, closed loop cord.

4. Apparatus of claim 2, wherein said first cord element approaches said gripping means from a first direction and said second cord element approaches said gripping means from a second direction, such that said first and second cord elements define an angle of greater than 90 degrees between them, whereby turning of said crankhead in first direction simultaneously winds said first and second cord elements about said bar member from different directions.

5. Apparatus for supporting books or like articles, comprising:

first end member including an article abutting surface for supportably abutting such article;

second end member including an article abutting surface normally disposed in opposed relation to said surface of said first end member for supportably abutting articles therebetween;

said second end member being movable relative to said first end member for adjusting the spacing between said surfaces;

elongated bar member mounted on said first end member;

support means for supporting said bar member in a rotatable fashion, said bar member being supported rotatable about its longitudinal axis;

crankhead connected to said bar member;

cord accepting bore formed in said bar member and extending through said bar member at an angle to the longitudinal axis of said bar member;

normally relaxed cord member intertying said first end member and said second end member to limit the distance to which said second end member is movable away from said first end member, said cord member passing from said second end member to said first end member and back to said second end member, after passing through said cord accepting bore of said bar member mounted on said first end member;

whereby turning of said crankhead in a first direction rotates said bar member about its longitudinal axis, twists said cord member passing through said cord accepting bore and winds said cord member from two directions about said bar member to decrease the distance to which said second end member is movable away from said first end member, and turning of said crankhead in a second direction rotates said bar member and unwinds said cord member from said bar member to increase the distance to which said second member is movable away from said first end member.

6. Apparatus of claim 5, wherein the two free ends of said cord member interconnect to define a continuous, closed loop cord.

7. Apparatus of claim 5, further comprising:

two spaced apart passageways defined in said first end member, each said passageway extending through said article abutting surface of said first end member;

two spaced apart passageways defined in said second end member, each said passageway extending through said article abutting surface of said second end member; and wherein said cord member passes through all four of said passageways, whereby two sections of said cord member are maintained in spaced apart relationship as they span between said first and second end members.

* * * * *